US007073427B2

(12) United States Patent
Donders

(10) Patent No.: US 7,073,427 B2
(45) Date of Patent: Jul. 11, 2006

(54) HYDROSTATIC MACHINE WITH COMPENSATED SLEEVES

(75) Inventor: Steven Donders, Horb (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 84 days.

(21) Appl. No.: 10/488,444

(22) PCT Filed: Sep. 5, 2002

(86) PCT No.: PCT/EP02/09954

§ 371 (c)(1),
(2), (4) Date: Mar. 3, 2004

(87) PCT Pub. No.: WO03/025347

PCT Pub. Date: Mar. 27, 2003

(65) Prior Publication Data

US 2004/0247454 A1 Dec. 9, 2004

(30) Foreign Application Priority Data

Sep. 19, 2001 (DE) ..... 101 46 137
Nov. 22, 2001 (DE) ..... 101 57 248

(51) Int. Cl.
*F01B 3/00* (2006.01)

(52) U.S. Cl. ..... 92/12.2; 92/144; 92/154; 92/169.4; 91/46

(58) Field of Classification Search ..... 92/12.2, 92/71, 72, 144, 154, 169.4; 91/473, 504, 91/46; 417/269
See application file for complete search history.

(56) References Cited

U.S. PATENT DOCUMENTS 3,142,262 A * 7/1964 Firth et al. ..... 92/12.2
4,026,195 A * 5/1977 Forster ..... 92/12.2
4,776,260 A * 10/1988 Vincze ..... 417/269
5,971,717 A 10/1999 Berthold

FOREIGN PATENT DOCUMENTS

| | | |
|---|---|---|
| DE | 1403754 | 1/1969 |
| DE | 28 12 416 A 1 | 10/1979 |
| DE | 28 12 418 A 1 | 10/1979 |
| DE | 2008 122 | 6/1983 |
| DE | 44 23 023 A1 | 1/1996 |
| DE | 198 37 647 A 1 | 3/2000 |
| EP | 1 156 212 A2 | 11/2001 |
| GB | 992230 | 5/1965 |

* cited by examiner

*Primary Examiner*—Igor Kershteyn
(74) *Attorney, Agent, or Firm*—Scully, Scott, Murphy & Presser

(57) ABSTRACT

A hydrostatic machine with a cylinder block (6), within which sleeve holes (28*b*) are arranged, in which sleeves (28) sit, surrounding piston bores (28*a*) in which pistons (29) are mounted, such as to be displaced back and forth and the pistons (29) extend into the cylinder block (5) such as to define cylinders (26) with the front ends thereof. According to the invention, the risk of piston seizure can be reduced, whereby the sleeves (28) comprise an axially-defined recess (41) in the outer surface thereof, in the region facing away from the cylinder and the region with the greatest piston radial force, pressing the pistons (29) against the wall of the piston bore.

21 Claims, 4 Drawing Sheets

HYDROSTATIC MACHINE WITH COMPENSATED SLEEVES

BACKGROUND OF THE INVENTION

1. Field of the Invention

The invention relates to a hydrostatic machine.

2. Discussion of the Prior Art

A hydrostatic machine of such kinds is described in DE 44 23 023 A1. In the case of this previously-known hydrostatic machine, the sleeves, in order to avoid piston seizure, are cooled with a cooling flow of the hydraulic fluid, which flows during operation through a respective cooling channel, which roughly radially extends outwards from the leakage chamber in a central hole of the cylinder block and opens out into the leakage chamber outside the cylinder block. The respective cooling channel extends through an inner annular groove in the wall of the sleeve hole seating the associated sleeve or through an inner annular groove in the inner surface of the sleeve. This previously-known cooling method worked satisfactorily in practice, but it is complex since each sleeve must be connected to the radial cooling channel, for the purpose of which annular grooves have to be machined in the sleeves and radial cooling channel sections incorporated in the cylinder block. In addition, this method depends on correctly functioning cooling circuits. If even one cooling channel becomes blocked, unwanted piston seizure can be expected, because the cooling is interrupted or at least reduced.

The danger of piston seizure is caused by increased heating in the region of the sleeves, which develops due to high friction energy from the sliding friction generated between the pistons and the sleeves. The friction energy increases when relative velocities between the pistons and the sleeves become greater. The relative velocity is dependent on the stroke length of the pistons and the speed of revolution of the hydrostatic machine, for example the speed of revolution of a cylinder block formed as a rotatable cylinder drum. At the same time, the greatest friction energy is generated in each case, if the cylinder block is formed by a rotatable cylinder drum, in the region of the centre of gravity of the pistons, when the cylinder drum rotates at high speed of revolution. If the cylinder block is not rotatable or if the cylinder drum rotates at low speed of revolution, the largest friction energy is generated in the region of a radial component of the piston force pointing in the direction of rotation.

Although DE 198 37 647 A1 describes an axial piston machine with sleeves, which according to FIG. 5 have in their longitudinal centre an annular groove in the form of a narrow groove in their outer surface, it is the purpose of this previously known configuration to obtain an annular bulge of the sleeve radially directed inwards by the operating pressure.

SUMMARY OF THE INVENTION

The object of the invention in the case of a hydrostatic machine of the kind initially indicated is to reduce the danger of piston seizure and to improve the effectiveness of the measures to prevent piston seizure. At the same time, the complexity of manufacture should be low, in order to keep the manufacturing costs also at a minimum.

This object is achieved by the features of claim 1 or 2. Advantageous refinements of the invention are described in the sub-claims.

In the case of the hydrostatic machine according to the invention, the respective sleeves in their region facing away from the cylinder and at least in the region of the greatest piston radial force pressing the piston against the wall of the piston bore comprise an axially-defined recess in the outer surface thereof or in the inner surface thereof.

The invention is based on the realization that increased heating between the pistons and the sleeves is mainly caused by two functional criteria. On the one hand, the friction energy and the heating resulting thereby are increased by high relative velocities between the pistons and the sleeves. On the other hand, it is increased if the hydrostatic machine operates at low pressure, in particular at zero pressure and, in particular at high speed of revolution. The latter can be attributed to the fact that when operating at low pressure, less leakage oil emerges through the clearance of movement between the pistons and the sleeves and also therefore less heat is dissipated, as a result of which greater heating is inevitable.

The configuration according to the invention in the aforementioned problem and functional cases leads to the desired improvement for the following reasons. The respective recess according to the invention creates on the radial exterior or interior of the sleeve a free space between this and the wall of the associated sleeve hole (claim 1) or the surface of the associated piston (claim 2), into which the wall of the sleeve can expand on being heated. Therefore, the piston clearance is reduced less if there is expansion, so that even if the hydrostatic machine is operated at zero-pressure, sufficient piston clearance is ensured and therefore piston seizure or the danger thereof is avoided or at least reduced.

The invention is based on the further realization that a sleeve expands radially outwards on being heated due to its sleeve shape, as long as this is possible. This is due to the annular sleeve shape and basically also applies to the region, in which the recess is arranged. Therefore in the case of the configuration according to the invention, no inward expansion of the wall of the sleeve in the region of increased heating occurs or at least such expansion is reduced.

Due to the axial definition of the recess, this is enclosed both towards the associated cylinder and towards the free inner space of the machine. The width of the recess extending in the circumferential direction can be dimensioned—just as its axial length—greater than the region, in which increased friction takes place and intensified expansion can be expected. However, even smaller dimensioning also leads to improvement. In the case of a constant machine the width of the recess can correspond to its axial length. In the case of a machine which can be adjusted in regard to its throughput volume the recess can be formed oblong in the longitudinal direction of the sleeve and to be precise, for example, longer by the length of the maximum stroke than the aforementioned endangered region.

For reasons of simple manufacture and assembly, it is advantageous to form the recess as an annular recess. Such a configuration is easy to manufacture by a rotational movement of the sleeve and also when assembling the sleeve it is not necessary to place it in a specific position with regard to its circumferential direction.

In addition, it is advantageous to form the recess with the cross section rounded, in order to avoid material breakage due to delicate corners or edges.

BRIEF DESCRIPTION OF THE DRAWINGS

Below, advantageous configurations of the invention will be described in more detail with reference to preferred embodiments and drawings, which show.

DETAILED DESCRIPTION OF THE INVENTION

Figure 1:
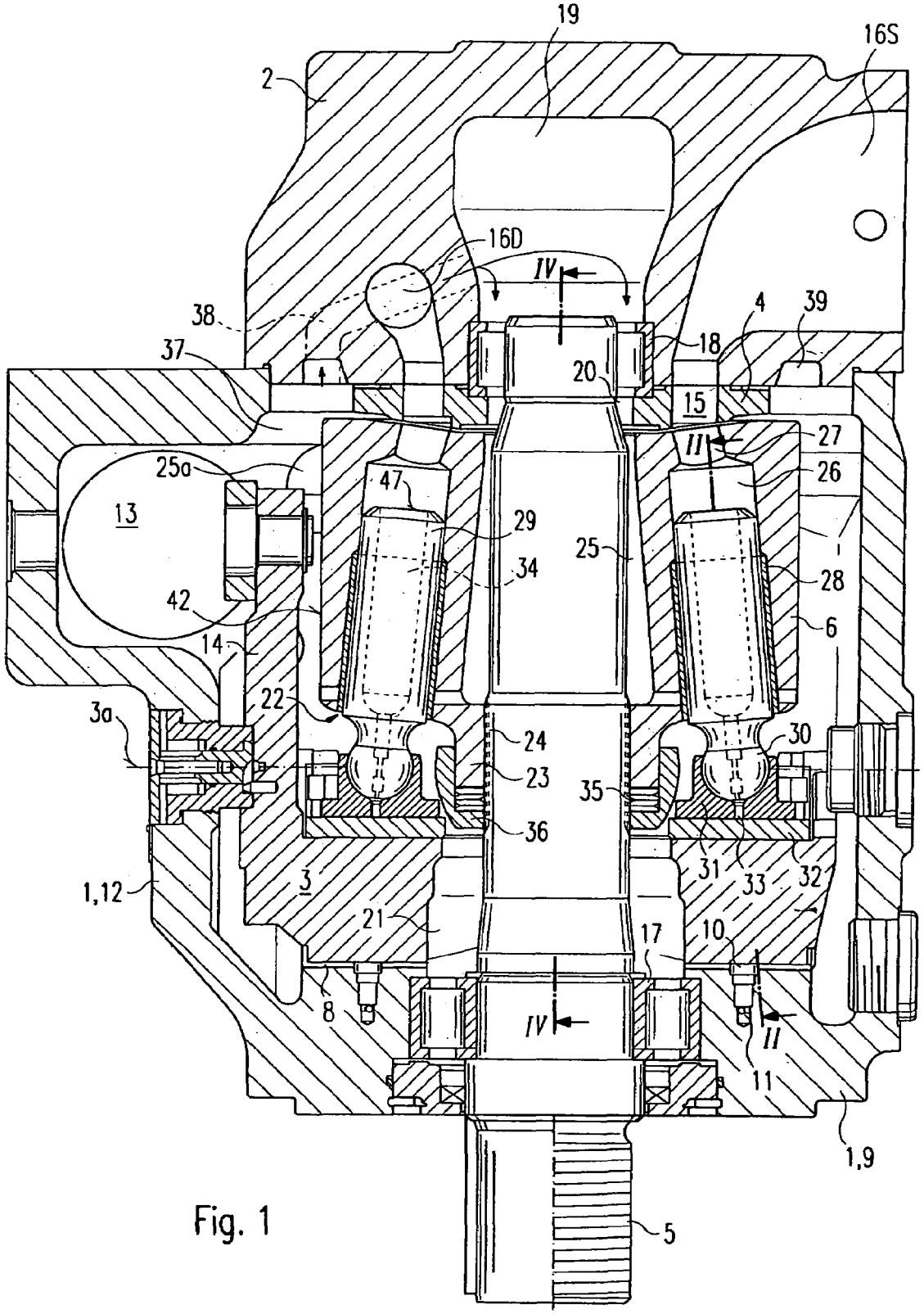
FIG. 1 an axial piston machine in axial section according to the invention
Figure 4:
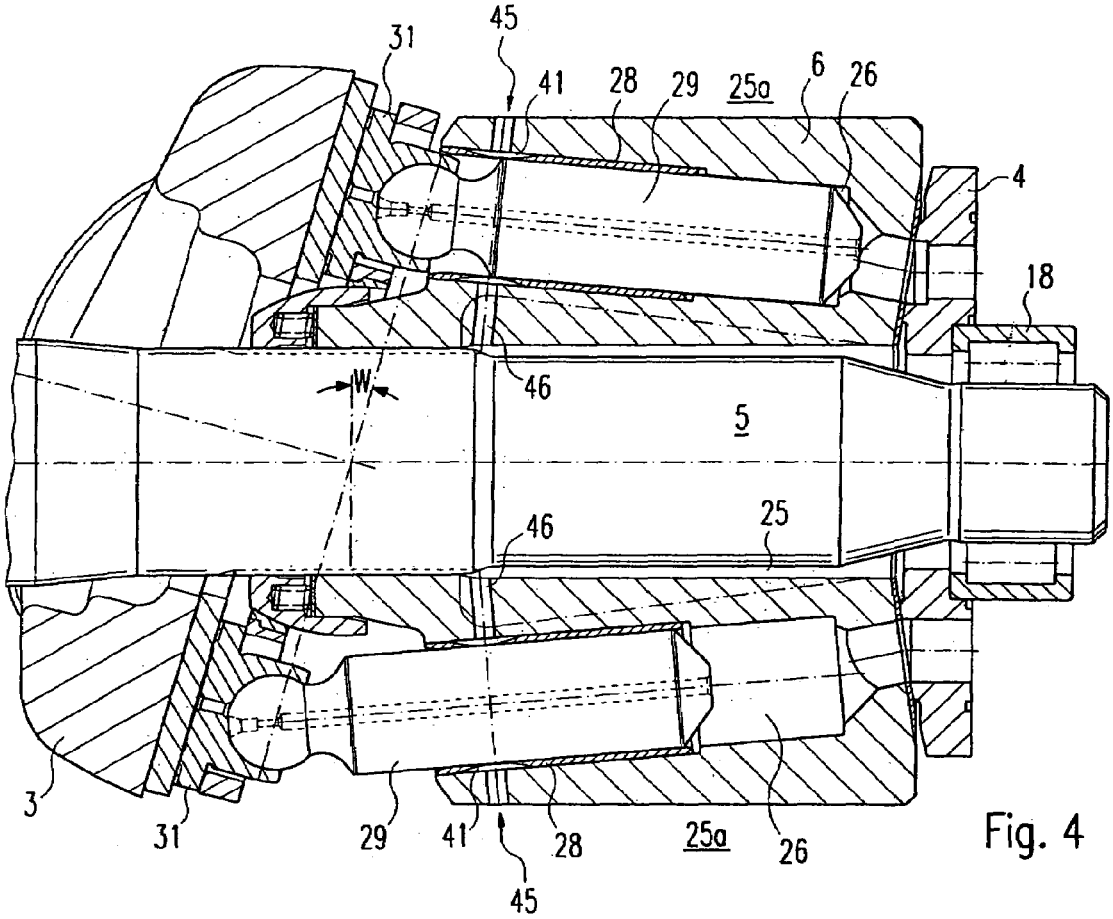
FIG. 4 cut out along line IV—IV in FIG. 1, whereby only significant parts of the axial piston machine are illustrated.

The axial piston machine illustrated in FIGS. 1 and 4 is of swash plate construction having adjustable displacement volume and includes in a known manner as main components a hollow cylindrical housing 1 having one end (upper end in FIG. 1) open at the end face, a connection block 2 attached to the housing 1 and closing the open end of the housing, a swash plate 3, a control body 4, a drive shaft 5 and a cylinder drum (cylinder block) 6. The axial piston machine can also within the scope of the invention concern a constant machine. In addition, the axial piston machine can be equipped for pumping and/or motor operation and/or for operating in alternating directions of rotation.

The swash plate 3 is formed as so-called tilting rocker with half-cylindrical cross section and bears with two bearing surfaces extending parallel to the tilt direction and with mutual radial spacing, under hydrostatic balancing on two correspondingly formed bearing shells 8, which are attached to the inner surface of the housing end wall 9 opposite to the connection block 2. The hydrostatic balancing is effected in known manner via pressure pockets 10, which are formed in the bearing shells 8 and are supplied with pressure medium via connections 11. A setting device 13 accommodated in a bulge in the cylindrical housing wall 12 engages the swash plate 3 by means of an arm 14 extending in the direction of the connection block 2 and serves for tilting the swash plate around a tilt axis 3*a* perpendicular to the tilt direction.

The control body 4 is attached on the inner surface of the connection block 2 towards the housing inner chamber and is provided with two through-going openings 15 in the form of kidney-shaped control slits, which are connected via a pressure channel 16D and suction channel 16S in the connection block 2 to a pressure and suction line (not shown). The pressure channel 16D has a smaller cross-section than the suction channel 16S. The spherically formed control surface of the control body 4 towards the housing inner chamber serves as bearing surface for the cylinder drum 6.

The drive shaft 5 penetrates through a through-bore in the housing end wall 9 into the housing 1 and is rotatably mounted by means of a bearing 17 in this through-bore and by means of a further bearing 18 in a narrower bore section of a blind bore 19 in the connection block 2, which blind bore is widened towards its end, and a region of a central through-bore 20 in the control body 4 bounding on this narrower bore section. The drive shaft 5 penetrates, in the interior of the housing 1 further a central through-bore 21 in the swash plate 3, the diameter of which is dimensioned according to the largest tilt movement of the swash plate 3, and a central through-bore having two bore sections, in the cylinder drum 6.

One of these bore sections is formed in a sleeve-like extension 23 formed on the cylinder drum 6, and extending beyond the end face 22 towards the swash plate 3, via which extension the cylinder drum 6 is rigidly connected with the drive shaft 5 by means of a splined connection 24. The remaining bore section is formed with a conical development; it tapers starting from its cross section of largest diameter near to the first bore section down to its cross section of smallest diameter near to the end or bearing surface of the cylinder drum 6 abutting on the control body 4. The annular chamber defined by the drive shaft 5 and this conical bore section is indicated with the reference symbol 25.

The cylinder drum 6 has generally axially or convergently forward running, stepped cylinder bores 26 which are arranged evenly on a pitch circle coaxial with the drive-shaft axis and which open at the cylinder drum end face 22 directly and at the cylinder drum bearing surface towards the control body 4 via opening channels 27 on the same pitch circle as the control slits. In each case, a sleeve 28 is placed in the cylinder bore sections of larger diameter, which open directly at the cylinder drum end face 22. The cylinder bores 26 together with the sleeves 28 are here referred to as cylinders. Within these cylinders 26 displaceably arranged pistons 29 are provided at their rear ends towards the swash plate 3 with ball heads 30, which are mounted in slippers 31 and via these are mounted hydrostatically on an annular slide disc 32 attached to the swash plate 5. Each slipper 31 is provided at its slide surface towards the slide disc 32 with a pressure pocket (not shown), which is connected with a possibly stepped axial through-channel 34 in the piston 29 via a through-bore 33 in the slipper 31 and in this way is connected with the working chamber of the cylinder bounded by the piston 29 in the cylinder bore 26. In each axial through-channel 34 in the region of the associated ball head 30 there is formed a choke. A holding-down device 36 arranged axially displaceably on the drive shaft 5 by means of the splined connection 24 and acted upon by means of a spring 35 in the direction of the swash plate 3 holds the slippers 31 in abutment on the slide disc 32.

The space within the housing inner chamber which is not taken up by the components 3 to 6 etc. therein accommodated serves as a leakage chamber 37, which receives the leakage fluid emerging during operation of the axial piston machine through all gaps, such as for example between the cylinders 26, 28 and the piston 29, the control body 4 and the cylinder drum 6, the swash plate 3 and the slide disc 32, and the bearing shells 8 etc.

The functioning of the above-described axial piston machine is generally known and in the following description, relating to use as a pump is restricted to that which is significant.

The axial piston machine is provided for operation with oil as fluid, for example. Via the drive shaft 5, the cylinder drum 6 together with the pistons 29 is set into rotation. When through actuation of the setting device 13 the swash plate 3 is tilted into a tilted position (c.f. FIG. 4) with respect to the cylinder drum 6, all pistons 29 carry through stroke motions; with rotation of the cylinder drum 6 by 360° each piston 29 runs through a suction stroke on the suction side and a compression stroke on the radially opposite pressure side, whereby corresponding flows of oil are generated, the supply and discharge of which are effected via the opening channels 27, the control slits 15 and the pressure and suction channel 16D, 16S. The suction and pressure sides rotate with the cylinder drum 6 continuously around the rotational axis of the axial piston machine. Thereby during the compression stroke of each piston 29, pressure oil runs from the cylinder 26, 28 concerned via the axial through-channel 34 and through-bore 33 in the associated slipper 31 into the pressure pocket thereof and builds up a pressure field between the slide disc 32 and the respective slipper 31, which serves as a hydrostatic bearing for the latter. Further, pressure oil is delivered into the pressure pockets 10 in the bearing shells 8 for hydrostatic support of the swash plate 3, via the connections 11.

Figure 2:
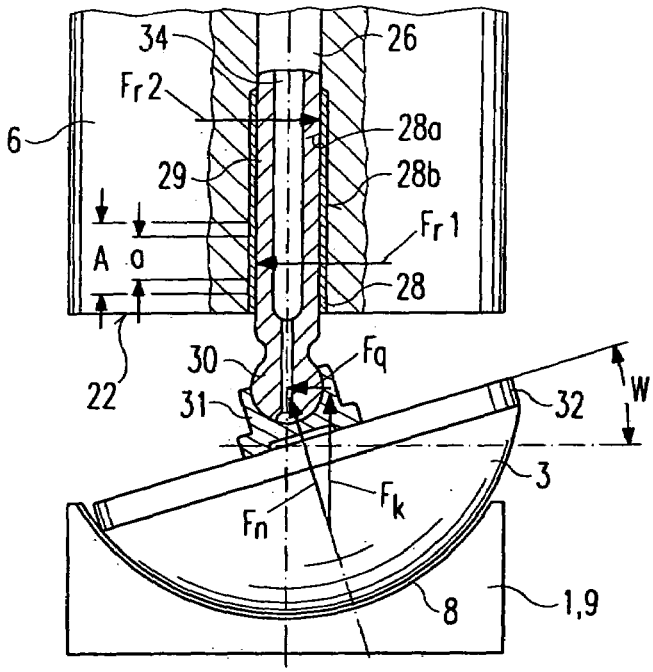
FIG. 2 a piston and its guidance region in a cylinder drum cut out along line II—II in FIG. 1.
Figure 3:
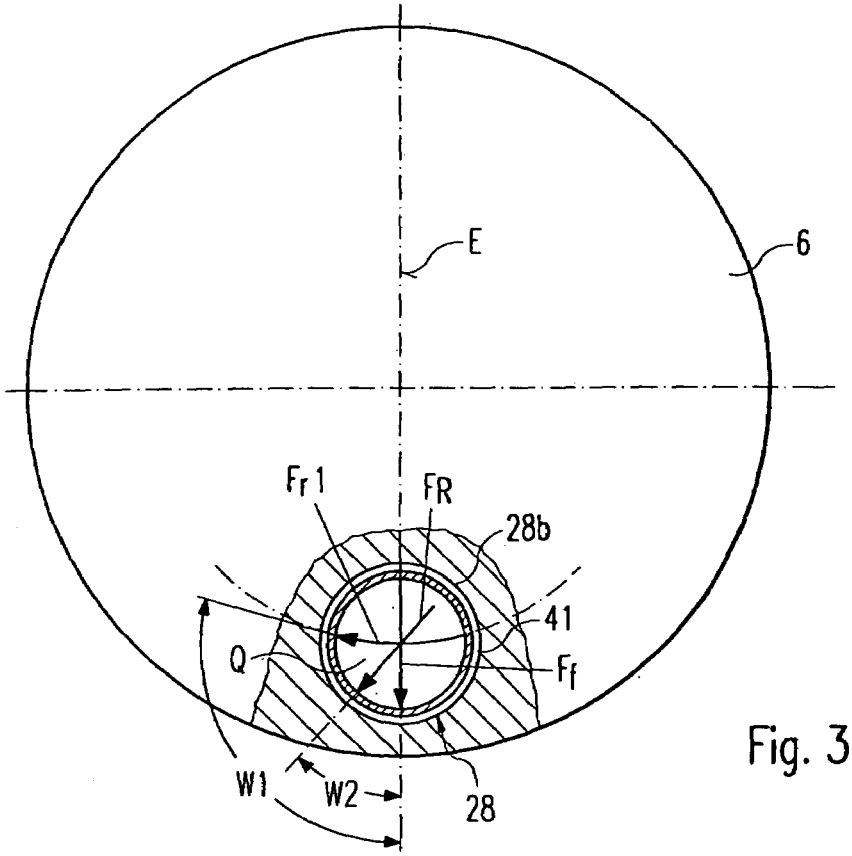
FIG. 3 the guidance region in axial schematic representation.

During the compression stroke, a normal force $F_n$ is exercised by the swash plate 3 on each slipper 31, which force with negligible friction acts vertically on the swash plate 3. In the ball piston 30 this normal force is resolved into a piston force $F_k$ and a radial or transverse force $F_q$. The transverse force $F_q$ acts in the ball head 30 on the piston 29 as upon a bar mounted in the cylinder drum 6, which brings about as indicated in FIG. 2 the radial forces $F_r$1, $F_r$2, by which the piston 29 is pressed against the sleeve 28, with corresponding axial spacing of their actions oppositely directed and directed in the circumferential direction of the cylinder drum 6. As the rear radial force $F_r$1 is greater than the end face radial force $F_r$2, in the following the case is argued only with the rear radial force $F_r$1.

Under the effect of the radial force $F_r$1 in particular if there is high relative velocity between the piston 29 and the guide face 28*a* of the sleeve 28, greater heating, respectively a higher temperature, is generated on the pressure side due to the increased sliding friction in the working area A illustrated in FIG. 2 in the wall of the sleeve 28, whereby the latter expands due to heating in particular in the working area A. Since the sleeve 28 through its tight fit in the associated sleeve-seating bore 28*b* is prevented from radially expanding outwards, it would radially expand inwards as a result of which the piston clearance would be reduced and the piston 29 could be squeezed with the result that the guide bearing could be damaged for example due to the piston 29 seizing or the slipper 31 possibly being torn off, which would lead to total destruction of the machine. The dimensions of the working area A representing a problem zone are formed in the circumferential direction through the heated zone a and in the axial direction through the heated zone a plus the piston stroke as indicated in FIG. 2.

The load case detailed above is described for pump operation of the axial piston machine. A similar load case with comparable radial forces $F_r$1, $F_r$2 also results if the axial piston machine is operated as a motor, during which the pistons 29 are axially pressed on the pressure side against the swash plate 3 and forces $F_n$ and $F_k$ arise in the opposite working direction. A functional difference between pump operation and motor operation resides in the fact that with pump operation the direction of rotation of the cylinder drum 6 is opposed to the piston radial force $F_r$1 and with motor operation the piston radial force $F_r$1 and the direction of rotation point in the same circumferential direction. During either type of operation, it applies that the piston radial force $F_r$1 is directed into the circumferential direction, in which the angle of inclination W is enclosed.

Figure 5:
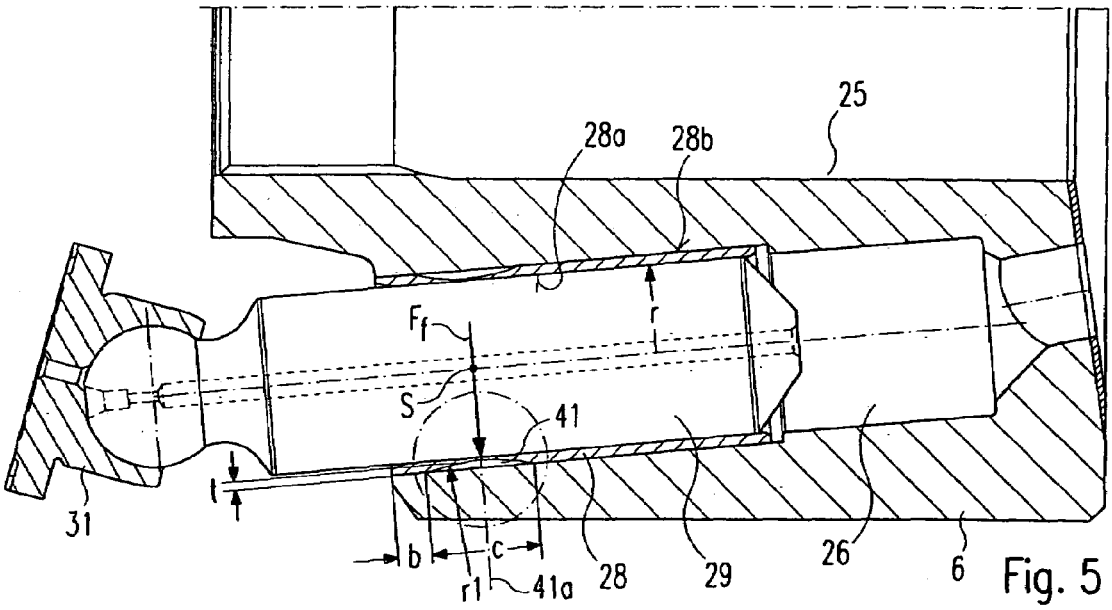
FIG. 5 the guidance region of a piston in axial section and in enlarged representation.

A load case taking place simultaneously or alone during operation with the load case described above results according to FIGS. 3 to 7 due to the centrifugal forces $F_f$ acting upon the piston 29, which are radially directed outwards and—seen in the transverse direction of a longitudinal plane E containing the longitudinal central axis of the axial piston machine and the longitudinal central axis of the piston 29 concerned according to FIGS. 1, 4 and 5—engage in the centre of gravity S (FIG. 5) of the piston 29 or the piston assembly consisting of the piston 29 and the slipper 31. In contrast to the radial forces $F_r$1, $F_r$2, the size of which increases with rising working pressure in the cylinders 26, 28, the piston centrifugal forces $F_f$ depend on the speed of revolution of the cylinder drum 6 and increase with rising speed of revolution, whereby the size of the working pressure is not relevant. Although with this load or functional case an area A representing a problem zone and a heated zone a corresponding to the load or functional case according to FIG. 2 are equally present, it is arranged in the plane E, whereby the centrifugal force $F_f$ in the longitudinal plane E is substantially radially effective outwards.

During operation of the axial piston machine, if the axial piston machine runs at considerable working pressure and at considerable speed of revolution, in each case the radial force $F_r$1 and piston centrifugal force $F_f$ form a resultant radial force FR, radially effective outwards, which is effective in the angle range W1 extending between the radial force $F_r$1 and piston centrifugal force $F_f$, whereby the respective effective working point of the resultant radial force FR depends on the particular actual size of the working pressure or radial force $F_r$1 and the speed of revolution or centrifugal force F and therefore can be arranged out of line with the working point of the radial force $F_r$1 or the working point of the piston centrifugal force FR. For the resultant piston force FR therefore an angle range corresponding to the angle range W1 or the quadrant Q substantially limited by it therefore results. For simplification, therefore, a central position for the resultant piston force FR, in which the latter encloses an angle W2 of about 45° with the plane E containing the longitudinal central axis of the axle piston machine and the longitudinal central axis of the piston 29 concerned, can be assumed as particularly advantageous. Since the pistons 29 move back and forth during operation, for the purpose of further simplification it can be assumed—seen across the longitudinal central axis of the piston 29 concerned—that the resultant piston force FR is effective in a working range between the working ranges brought about by the piston centrifugal force $F_f$ and the radial force $F_r$1. Such a load case or functional case applies for example if the axial piston machine is driven when operating as a motor by the working pressure and in particular reaches high speeds of revolutions if the axial piston machine has a small throughput volume (constant machine) or is set for a small throughput volume. In this case, the axial piston machine can be formed by the motor of a hydrostatic transmission.

A further functional criterion and/or another functional case, in which increased friction or increased heating resulting thereby of the sleeve 28 occurs, if the axial piston machine operates substantially at zero pressure or at minimum working pressure. In this case, little or substantially no leakage fluid emerges through the piston clearance and therefore little or substantially no friction heat is dissipated, as a result of which increased heating of the zone concerned can occur with the functional problems described above.

To avoid or reduce the problem described above the respective sleeves 28 according to a first embodiment have on their outer surface at least in the region in which they are radially pressed by the associated piston 29 with the greatest pressure force for example $F_r$1 or FR or $F_f$, have a recess 41, the dimension of which extending in the circumferential direction of the piston 29, can correspond to the heated zone a, for example the radius r of the piston 29, and the axial dimension of which can correspond to the area A. The recess 41 or its central axis 41*a* can be arranged in the region of the longitudinal central plane E, and to be precise in particular if the axial piston machine is operated at high speeds of revolutions and at low working pressure.

If an axial piston machine, which operates at high working pressure and at relatively low speeds of revolution, is concerned, it is advantageous to arrange the recess 41 on the side of the piston 29, which points in the direction of rotation.

If the axial piston machine has to meet both aforementioned functional criteria, it is advantageous to arrange the recess 41 or its central axis 41*a* in the region of the outer quadrant Q directed in the circumferential direction of the sleeve 28, whereby the angle of inclination W is enclosed in this circumferential direction. In this case, the recess 41 depending on the operating conditions in regard to the speed of revolution and working pressure can be arranged on the longitudinal plane E or offset in the quadrant into the direction of rotation or extending beyond this. For simplification of construction, it can be advantageous to arrange the position of the recess 41 only in the region of the resultant radial force FR.

Seen transverse to the piston or cylinder axis, the recess 41 can be arranged in the case of a constant machine in the central stroke area or in the case of an adjustable axial piston machine in the middle of the maximum stroke area. In this case, the recess 41 can be arranged in the central stroke area of the roughly radially working axis of the centre of gravity S in the case of a swash plate 3 tilted out to the minimum.

It has been shown that the position of the recess 41, 41*b*, 41*c* is advantageous if it is arranged in the rear opening out end, preferably completely in the opening out half of the sleeve 28. The distance b of the recess 41 from the rear or opening out end of the sleeve 28 can be 3 mm to 10 mm, in particular about 5 mm. In the case of the embodiment according to FIG. 4, the recess 41 or its central axis 41*a* is arranged in the region of the end region towards the swash plate 3 of the piston stroke when the swash plate 31 is tilted out roughly to the maximum.

Figure 6:
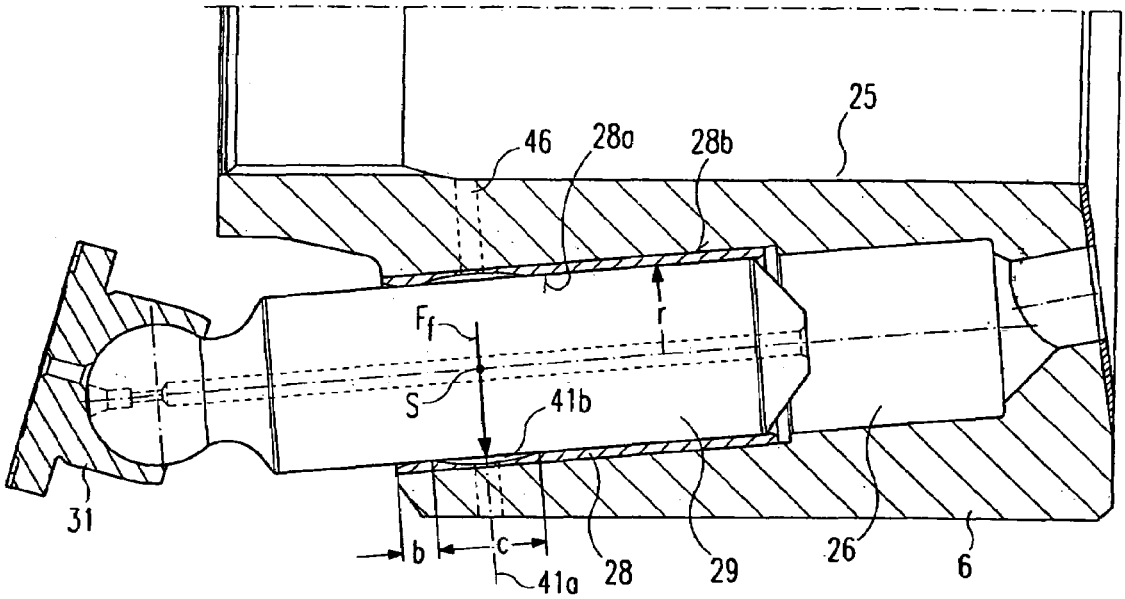
FIG. 6 the guidance region of a piston in modified configuration in enlarged axial section.

The recess 41 can be arranged in the inner surface of the sleeve 28 within the scope of the invention, instead of in the outer surface of the sleeve 28 as shown as an embodiment in FIG. 6, where similar or comparable parts are provided with the same reference numerals. In the case of this embodiment, the free space formed by the recess 41 is not situated between the sleeve 28 and the inner surfaces of the sleeve holes 28*a* but between the sleeves 28 and the associated pistons 29. On being heated, therefore, the material of the sleeves 28 can in each case expand into this free space, without the piston clearance being reduced. At the same time, it should be considered that the sleeves 28 cannot expand radially outwards, because they are surrounded by the inner surfaces of the sleeve holes 28*b*.

Figure 7:
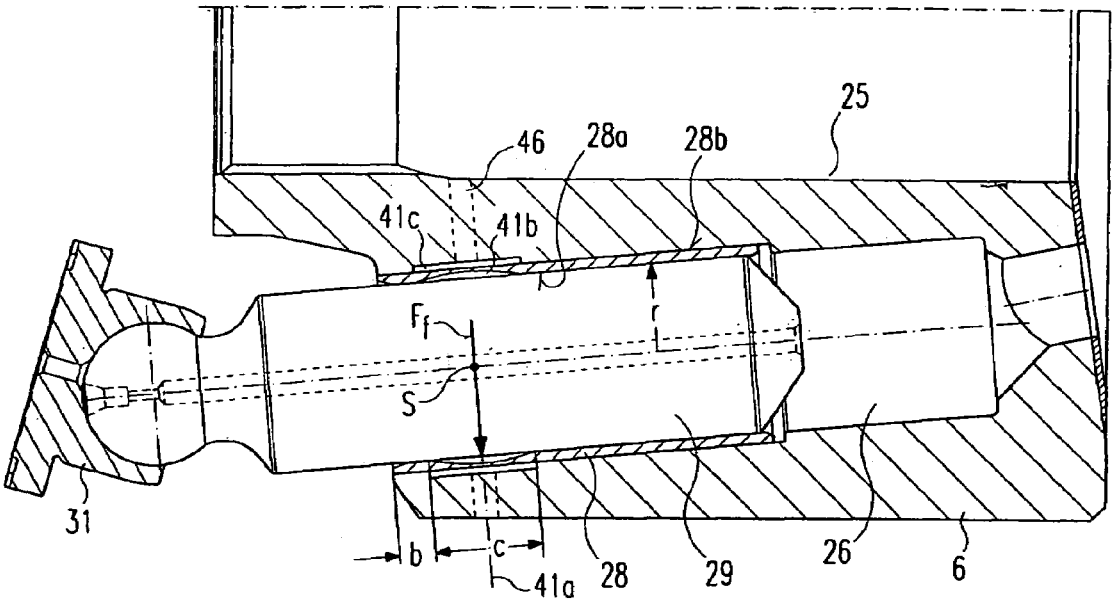
FIG. 7 the guidance region of a piston in a further modified configuration in enlarged axial section.

The embodiment according to FIG. 7 in which similar or comparable parts are also designated with the same reference numerals comprises a further modified configuration, in which additionally to the recesses 41 in the inner or guidance surfaces 28*a* of the sleeves 28 recesses 41 are also arranged in the inner surfaces of the sleeve-seating holes 28*b*.

Also, in the case of the configurations according to FIGS. 6 and 7, the recesses 41 need only to be located or extend in the region in which during operation increased heating or temperature increase can be expected, for example in the working area of the radial force $F_r$1 and/or in the region of centrifugal force $F_f$. Therefore, the positions described above for the embodiments according to FIGS. 1 to 5 apply for the recess 41 in the axial direction and/or in the circumferential direction also for the embodiments according to FIGS. 6 and 7. Regarding the embodiment according to FIG. 7, it should be added that the recess 41*b* in the inner surface of the sleeves 28 and the recess 41*c* in the inner surface of the seating holes 28*b* are each arranged in the same radial direction, so that they are radially arranged behind one another. If the recess 41*b* is provided, the material of the sleeves 28 can also expand in each case into the free space formed by the recess 41*b*, so that also a result of this a reduction in the piston clearance is prevented.

The axial dimension c of the recess 41, 41*b*, 41*c* can roughly correspond to 0.3 to 0.7 fold the inner diameter of 2r, preferably 0.5 fold, the inner diameter of 2r of the sleeve 28.

If the size of the recess 41, 41*b*, 41*c* in the circumferential direction is such that it extends over the entire quadrant Q it is suitable for the functional cases or functional criteria described above. This also applies if the recess 41, 41*b*, 41*c* is formed by an annular groove. Such a recess 41, 41*b*, 41*c* is easy to manufacture. In addition, when assembling the sleeve 28, it is not necessary to ensure that the recess 41, 41*b*, 41*c* is placed in a specific position. Due to its annular form the recess 41, 41*b*, 41*c* fits in all rotational positions of the sleeve 28 and therefore this can be provided in any rotational position.

For the purpose of avoiding edges which may create weakness or edges inclined to break it is advantageous to form the recesses 41, 41*b*, 41*c*—here in the longitudinal cross section—in each case with a rounded concave or spherical segment shape. Such a shape is also designated as a spherical cap. The radius r1 of the preferably spherical segment shaped rounded recess surface approximately corresponds to four to six-fold, in particular about five-fold, the inner diameter 2r. The depth t of the recess 41, 41*b* should be about 1 to 10%, in particular about 5% of the inner radius r. In the case of the recess 41*c* this applies for the inner radius of the seating holes 28*b*.

In the following, a few further advantageous features of the invention are described. Within the scope of the invention, it is possible and advantageous to form the sleeve 28 with the recess 41 in the region contacting the cylinder drum 6 enclosing it so that if the friction pairing is heated up during operation the piston clearance (gap width) between the piston 29 and the sleeve 28 remains the same in the region of the recess as a result of thermal compensation (precise compensation). This configuration is also possible if the gap width is increased due to rising heating (over compensation). If the gap width is reduced, this configuration is also possible with increasing heating (under compensation). This configuration is also possible if any random gap contour is set on the basis of a corresponding groove dimension.

It is also advantageous to cool the sleeves 28 in particular in the region of the recess 41, 41*b*, 41*c* with a cooling device 45. The cooling device can correspond to the configuration disclosed in DE 44 23 023 A1, where an approximately radial cooling channel 46 penetrating the sleeve hole 28*b* is provided in the cylinder drum 6, which connects the free inner space 25 of the cylinder drum 6 with the inner space 25*a* surrounding the cylinder block. In the case of the embodiment according to FIG. 6, the cooling channel 46 penetrates the associated sleeve 28 in the respective region of the recess 41*b*. In the case of the configuration according to FIG. 7 the cooling channel 46 can extend as far as the recess 41*c* or even into the recess 41*b*. Preferably, the cooling channel 46 is arranged in such a way that its central axis intersects the longitudinal central axis of the associated cylinder 26.

In the case of this cooling device 45 in particular with the configuration according to FIG. 1 during operation the hydraulic fluid or oil is pumped automatically and to be precise due to the centrifugal force, which acts upon the hydraulic fluid present in the cooling channels 46. As a result of a flow circuit connecting the inner space 25 with the inner space 25*a*, the automatic pumping of the hydraulic fluid described above is ensured. In the embodiment, the inner space 25*a* is connected by a channel 38 with the inner space 25 running for example in the connection block 2, here with the blind bore 19. As a result, a cooling circuit is created, which functions automatically during operation of the machine due to the effect of centrifugal force.

The invention claimed is:

1. A hydrostatic machine with a cylinder block having sleeve holes formed therein, sleeves seated in said holes and surrounding piston bore, pistons being mounted in said bores for reciprocatory displacement, said pistons extending into the cylinder block so as to define cylinders at front ends thereof, the sleeves each, in a region facing away from the cylinder and at least in a region of a greatest piston radial force pressing the piston against a wall of the piston bore, have an axially-defined recess which is arranged in a region of the center of gravity of the piston in an outer surface thereof, and wherein a throughput volume of the hydrostatic machine is adjustable and the recess is positioned in the region of the center of gravity when the hydrostatic machine is adjusted to a minimum throughput volume.

2. The hydrostatic machine according to claim 1, wherein said recess or the center axis thereof as viewed in the axial direction of the hydrostatic machine, is arranged in a region of an outer quadrant of the sleeve, whereby the quadrant is directed in a circumferential direction enclosing an angle of inclination.

3. The hydrostatic machine according to claim 1, wherein the recess and/or a further recess comprises an annular recess.

4. The hydrostatic machine according to claim 1, wherein the recess is entirely arranged in each instance in a longitudinal half of the sleeve facing away from the cylinders.

5. The hydrostatic machine according to claim 4, wherein the radius of the rounded shape corresponds to a four to six-fold of a the cross-sectional dimension of the piston bore.

6. The hydrostatic machine according to claim 1, wherein the respective recess is approximately 3 mm to 10 mm distant from ends of the sleeves facing away from the cylinders.

7. The hydrostatic machine according to claim 1, wherein an axial dimension of the recess corresponds to about 3/10 to 7/10 of the diameter of the piston bore.

8. The hydrostatic machine according to claim 1, wherein at least a base of the recess is rounded in a circular arc section shape.

9. The hydrostatic machine according to claim 8, wherein the radius of the rounded shape corresponds to a four to six-fold of a cross-sectional dimension of the piston bore.

10. The hydrostatic machine according to claim 1, wherein the recess is connected with a cooling channel of a cooling device which comprises a cooling circuit.

11. The hydrostatic machine according to claim 10, wherein the cooling channel connects a fluid space arranged in the cylinder block with a fluid space surrounding the cylinder block.

12. A hydrostatic machine with a cylinder block having sleeve holes formed therein, sleeves seated in said holes and surrounding piston bores, pistons being mounted for reciprocatory displacement, said pistons extending into the cylinder block so as to define cylinders at front ends thereof, the sleeves in each instance including an axially-defined recess which is arranged in a region of a center of gravity of the piston in an inner surface thereof in a region facing away from the cylinder, wherein the recess in each instance is located at least in a region of a greatest piston radial force pressing the piston against a wall of the piston bore, and wherein a throughput volume of the hydrostatic machines is adjustable and the recess is positioned in the region of the center of gravity, when the hydrostatic machine is adjusted to a minimum throughput volume.

13. The hydrostatic machine according to claim 12, wherein the sleeve holes, in each instance, viewed in said region of the inner surface of said piston facing away from the cylinder and at least in a region of the greatest piston radial force pressing the piston against the wall of the piston bore, have an axially-defined further recess in the inner surface thereof, and wherein the recess and the further recess are radially aligned with each other.

14. The hydrostatic machine according to claim 13, wherein the recess and/or the further recess comprises an annular recess.

15. The hydrostatic machine according to claim 12, wherein viewed in an axial direction of the hydrostatic machine, the recess or central axis thereof is arranged in a region of an outer quadrant of the sleeve, wherein the quadrant is directed in a circumferential direction enclosing an angle of inclination.

16. The hydrostatic machine according to claim 12, wherein the recess in each instance is arranged completely within a longitudinal half of the sleeve facing away from the cylinders.

17. The hydrostatic machine according to claim 12, wherein the respective recess is approximately 3 mm to 10 mm distant from ends of the sleeves facing away from the cylinders.

18. The hydrostatic machine according to claim 12, wherein an axial dimension of the recess corresponds to about 3/10 to 7/10 of the diameter of the piston bore.

19. The hydrostatic machine according to claim 12, wherein at least a base of the recess is rounded in a circular arc section shape.

20. The hydrostatic machine according to claim 12, wherein the recess is connected with a cooling channel of a cooling device which comprises a cooling circuit.

21. The hydrostatic machine according to claim 20, wherein the cooling channel connects a fluid space arranged in the cylinder block with a fluid space surrounding the cylinder block.

* * * * *